US008468700B2

(12) United States Patent
Wilson

(10) Patent No.: US 8,468,700 B2
(45) Date of Patent: Jun. 25, 2013

(54) EATING DEVICES WHICH REDUCE TREMORS OF THE HAND

(76) Inventor: Daniel Bruce Wilson, Asheville, NC (US)

( * ) Notice: Subject to any disclaimer, the term of this patent is extended or adjusted under 35 U.S.C. 154(b) by 448 days.

(21) Appl. No.: 12/831,444

(22) Filed: Jul. 7, 2010

(65) Prior Publication Data

US 2011/0005085 A1 Jan. 13, 2011

Related U.S. Application Data

(60) Provisional application No. 61/270,362, filed on Jul. 8, 2009, provisional application No. 61/342,647, filed on Apr. 15, 2010.

(51) Int. Cl.
*B26B 11/00* (2006.01)

(52) U.S. Cl.
USPC ..... 30/123; 30/147; 83/13

(58) Field of Classification Search
USPC ..... 30/123, 125, 137, 142–150; 83/13
See application file for complete search history.

(56) References Cited

U.S. PATENT DOCUMENTS

| | | | | |
|---|---|---|---|---|
| 2,487,274 | A | 11/1949 | Schaffer | |
| 2,674,793 | A | 4/1954 | Dominick | |
| 2,995,265 | A | 8/1961 | Soderberg | |
| 3,121,951 | A | 2/1964 | Green | |
| 4,218,167 | A | 8/1980 | Mansfield | |
| 4,325,187 | A * | 4/1982 | Wasson | 30/327 |
| 4,386,448 | A | 6/1983 | Kohn | |
| 4,821,417 | A | 4/1989 | Levine | |
| 4,835,864 | A | 6/1989 | Tang | |
| 5,060,386 | A * | 10/1991 | Mars | 30/327 |
| 5,068,967 | A | 12/1991 | Mars | |
| 5,630,276 | A * | 5/1997 | Weinstein | 30/324 |
| 5,860,190 | A | 1/1999 | Cano | |
| 6,490,760 | B1 | 12/2002 | Lauer et al. | |
| 6,698,065 | B2 | 3/2004 | Lauer | |
| 2003/0033023 | A1 * | 2/2003 | McCrae | 623/65 |

FOREIGN PATENT DOCUMENTS

| | | | |
|---|---|---|---|
| JP | 2002-85486 | * | 3/2002 |
| WO | WO2012/002889 | * | 1/2012 |

* cited by examiner

*Primary Examiner* — Phong Nguyen
(74) *Attorney, Agent, or Firm* — The Van Winkle Law Firm; David M. Carter

(57) ABSTRACT

There is provided an eating device including a grip configured so as to enable the grip to be grasped by a human hand. The grip is elongated and includes at least one side surface. An eating utensil having a front portion and a rear portion is provided. The front portion is configured to make contact with food and the rear portion extends from the side surface of the grip so that the front portion of the elongated utensil extends away from the side surface of the grip.

12 Claims, 4 Drawing Sheets

EATING DEVICES WHICH REDUCE TREMORS OF THE HAND

RELATED APPLICATIONS

This is a U.S. non-provisional application relating to and claiming the benefit of U.S. Provisional Patent Application Ser. Nos. 61/270,362, filed Jul. 8, 2009 and 61/342,647 filed Apr. 15, 2010.

BACKGROUND OF THE INVENTION

This invention relates to eating utensils. More particularly it relates to eating utensils which have been modified and enhanced for use by persons who are affected by tremors of the hand.

There are numerous diseases, disorders and conditions which exhibit the symptom of tremors of the hands. The following is a partial list of such diseases, disorders and conditions: Parkinson's Disease, Essential Tremor which is also referred to as Intentional Tremor, Familial Tremor which is also referred to as Benign Tremor, Drug Induced Tremor, Alcohol Withdrawal, Cigarette Smoking, Hyperthyroidism, Excess Use of Caffeine, Wilson's Disease, Post Trauma, Stroke, Senility, and Huntington's Cholera.

A victim of one or more of these maladies often has difficulty eating due to the tremor. Two of the more prevalent maladies which exhibit the symptom of tremor of the hands are Parkinson's Disease and Essential Tremor. Parkinson's Disease and Essential Tremor are diseases in which the area of the brain controlling movement of the body's muscles progressively dies. Controlled movements are replaced with tremor, especially in the extremities. Fingers and hands are almost always affected, as well as any process which requires fine motor skills.

Persons who have tremors in the hands have special difficulty in eating with a fork or a spoon. In addition, cutting food with a standard dinner knife is also hampered. The sufferer often can not eat as quickly as others who may be joining him or her at a meal. Also, the sufferer frequently spills food on his or her clothing as the tremor shakes the fork, spoon or knife. The sufferer is often embarrassed and stressed, particularly when eating with a group or in a restaurant. The sufferer often feels forced to select foods which can be easier to eat rather then foods which are preferred. There are many negative lifestyle and health changes relating to eating choices which are driven by the tremor, such as diminished self confidence, poor nutrition, and social isolation.

There are existing specially designed forks, spoons and knives available which claim to assist a hand tremor sufferer in eating. Often, the handles of these special utensils are somewhat larger then regular utensils and some of them have angled tines, blades and spoons. However, many of these utensils are designed for users who have arthritis or some other crippling condition and do not adequately address the tremor problem.

SUMMARY OF THE INVENTION

In accordance with one form of this invention, there is provided an eating device including a grip which is configured so as to enable the grip to be grasped by a human hand. An elongated utensil having a front portion and a rear portion is provided. The front portion of the elongated utensil is configured to make contact with the food. The rear portion of the elongated utensil is connected to the grip. The elongated utensil extends away from the grip. The elongated utensil and the grip each have a longitudinal axis. The angle between the longitudinal axis of the grip and the longitudinal axis of the elongated utensil is no less than seventy degrees)(70°) and no greater than one hundred ten degrees)(110°).

In accordance with another form of this invention, there is provided an eating device including a grip which is configured so as to enable the grip to be grasped by a human hand. The grip is elongated and includes at least one side surface. An elongated utensil having a front portion and a rear portion is provided. The front portion of the elongated utensil is configured to make contact with food. The rear portion of the elongated utensil extends through the side surface of the grip so that the front portion of the elongated utensil extends away from the side surface of the grip.

In yet another form of this invention, there is provided a method for enabling a person afflicted with a neuromuscular disorder to manipulate food without substantial hand tremors. An eating device is provided which includes an elongated grip having at least one side surface with an elongated utensil extending from the side surface. The eating device is arranged so that the elongated grip extends substantially vertically and the elongated utensil extends substantially horizontally. The grip is grasped by the afflicted person in the handshake position. The grip is squeezed by the afflicted person so as to apply pressure to the grip so that hand tremors are substantially relieved. Food is contacted with the elongated utensil.

DESCRIPTION OF THE PREFERRED EMBODIMENTS

Figure 1:
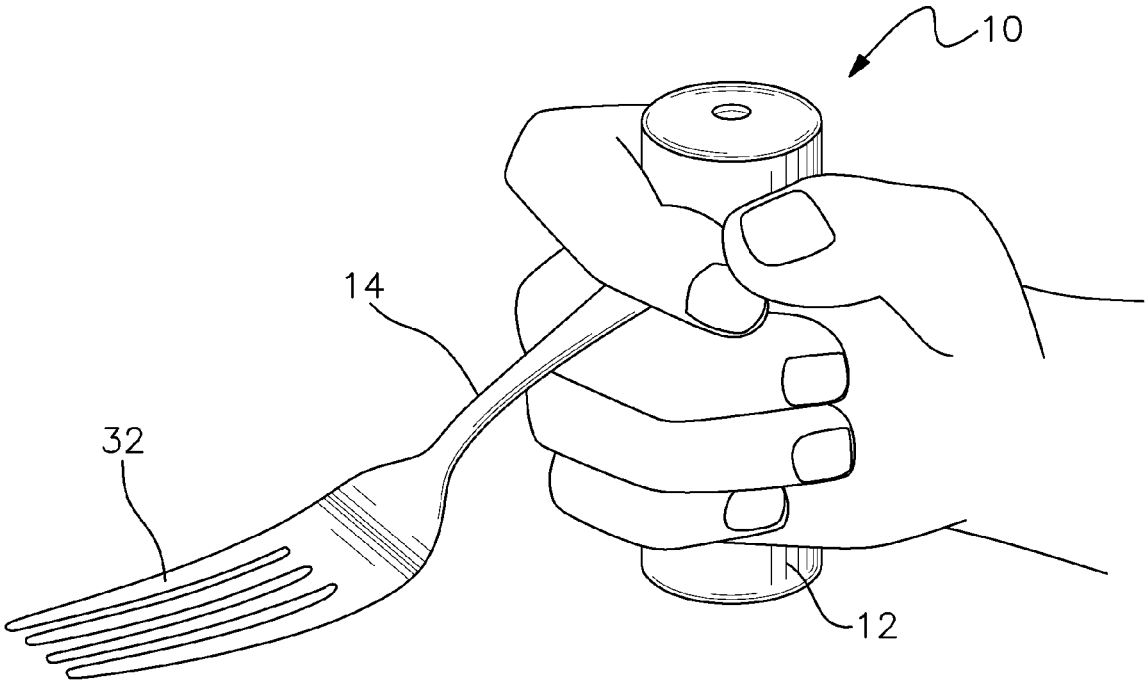
FIG. 1 is a perspective view showing one embodiment of the invention being grasped by a human hand.
Figure 2:
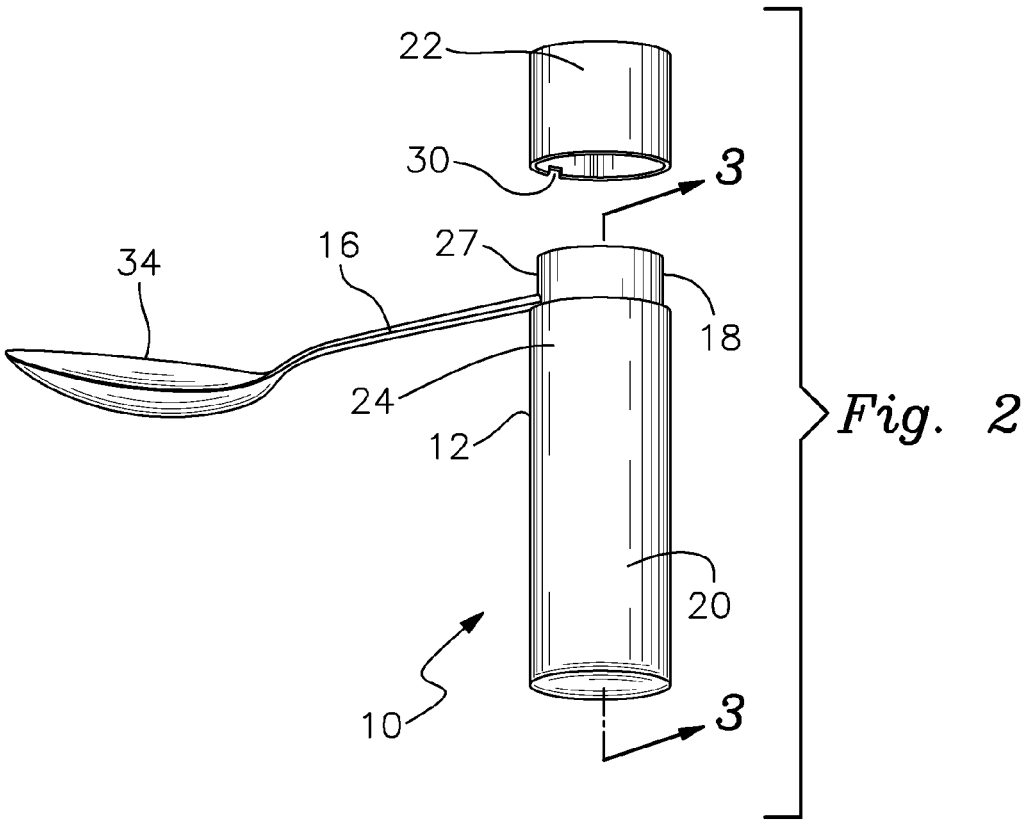
FIG. 2 is a side elevational view of the embodiment of FIG. 1 except that a different utensil is shown and the cap is shown removed.
Figure 3:
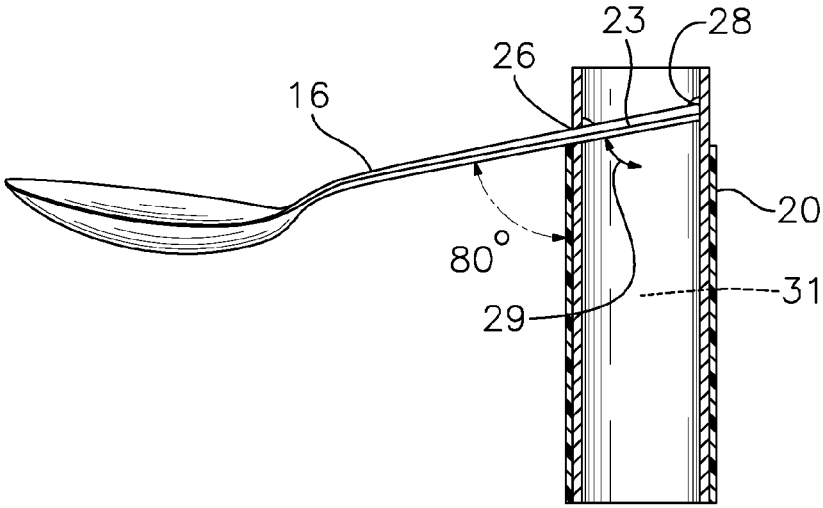
FIG. 3 is a sectional view of the embodiment of FIG. 2 taken through section line 3-3 with the cap not shown and with the utensil not being in section.
Figure 4:
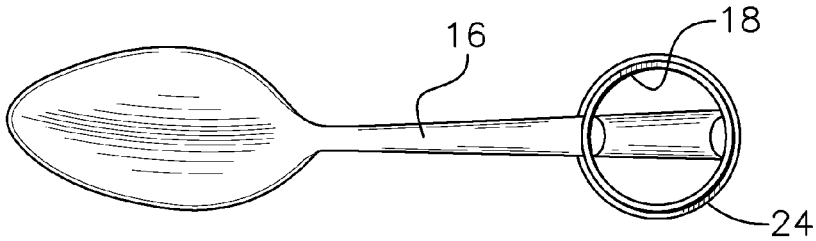
FIG. 4 is a top view of the embodiment of FIG. 3.

Referring now more particularly to FIGS. 1-4, there is provided eating device 10 including elongated grip 12, and elongated utensil such as fork 14 shown in FIG. 1 or spoon 16 shown in FIG. 2, attached to grip 12. Grip 12 includes hollow cylinder 18 which is preferably made from metal such as stainless steel. It is preferred that hollow cylinder 18 be at least one inch in diameter and more preferably approximately one and one-fourth inches in diameter. It is also preferred that hollow cylinder 18 be at least three inches long and more preferably approximately three and seven-eighths inches long. Preferably hollow cylinder 18 is covered by a thin layer of vinyl 20. The grip 12 includes a lower portion 20 which includes vinyl covered hollow cylinder 18. The vinyl cover includes cap 22 which forms the upper portion of the grip. The rear portion 23 of elongated utensil, fork 14 or spoon 16, is connected to the lower portion 24 of grip 12. Rear portion 23 extends through opening 26 in surface 27 of hollow tube 18 and is spot welded to an inner wall of hollow cylinder 18 at weld 28. Preferably, weld 28 is slightly higher then opening 26 so that angle 29 between the longitudinal axis 31 of the grip and the longitudinal axis of the elongated utensil is less than ninety degrees)(90°) and preferably approximately eighty degrees)(80°). In one embodiment, angle 29 is between seventy degrees) (70°) and one hundred ten degrees) (110°). It is also preferred that the rear portion 23 of the utensil 14 or 16 be spot welded to the tube 18 at opening 26.

Elongated utensil 14 or 16 extends through opening 30 in cap 22. Fork 14 includes front portion 32 and spoon 16 includes front portion 34, which is adapted to come in contact with food during eating. Preferably, fork 14 shown in FIG. 1 and spoon 16 shown in FIG. 2 are somewhat shortened so that the fork or spoon extends approximately five inches from the surface of grip 12. Preferably, opening 26 in hollow cylinder 18 is approximately one inch from the top of the hollow cylinder. Because of the curvature of a standard fork or spoon, the tines of the fork and the bowl of the spoon face somewhat upwardly when being used as shown in FIGS. 1 and 2. The lower vinyl cover extends from the bottom of the hollow cylinder to a point where it touches spoon 16 or fork 14 where it exits the hollow cylinder through hole 26. When the cap 22 is placed over the exposed portion of hollow cylinder 18, a portion of the fork or spoon is received in slot 30. Once the eating device is fully assembled, hollow cylinder 18 is substantially air tight, vinyl clad, and sealed with the ends being closed.

As shown in FIG. 1, the eating device 10 is designed to be grasped in the handshake position so that the grip fits comfortably in the palm of the hand. The handle of fork 14 or spoon 16 is designed to fit between the index and middle fingers of the user which helps stabilize the entire hand and not just the fingers. In addition, the weight of the eating device, which is preferably over five ounces, provides a comfortable heft in the palm of the hand which adds stability. In addition, the position of the utensil with respect to the grip enables the user to positively locate the position of the utensil. That is, the portion of the utensil which is contacting the grip provides a stop for the index and middle fingers.

When the user is properly holding the eating device as shown in FIG. 1 and moves to charge the fork tines 32 or spoon bowl 34 with food, he or she squeezes the grip in a firm fashion. This squeezing causes the tremor in the hand to virtually stop. During this lull in tremor activity, the user can take the time he or she needs to pick up the bite of food or soup and take it to the mouth without dropping or spilling. The user can then relax the pressure on the grip, chew and/or swallow the food. When it is time to take another bite, the user then squeezes the grip 12 in a firm fashion and repeats the process. This squeeze and relax eating approach for a person with hand tremors is very effective. The user can eat at his or her own pace and the eating process is much less tiring and stressful. While not being bound by any theory, it is believed that the muscles in the hands which are affected by the tremors are distracted while the hand is engaged in squeezing the grip. In addition, from an ergonomic standpoint, the grip fits into the palm of the hand in its most normal position, i.e., in the handshake position, and effectively becomes a part of the forearm, wrist and fingers. This positioning of the hand itself also discourages the tremor.

When it is time to wash the eating utensil, cap 22 is removed. The eating utensil can be washed throughout, including the inside of hollow cylinder 18. In addition, the lower vinyl portion can also be removed if the eating device is to be washed in a dishwasher.

Referring now more particularly to FIGS. 5-8, there is provided eating device 32, including elongated grip 34, formed from hollow metal cylinder 36, and vinyl coating 38. As in the case in the embodiment of FIGS. 1-4, it is preferred that hollow cylinder 36 be made of stainless steel. Knife 40 is attached to the lower portion of grip 34. Knife 40 includes front portion 42 which includes serrations 44 and rear portion 46. Rear portion 46 is received through slot 48 in hollow cylinder 36, as well as a slot in vinyl cover 38. Knife 40 extends from the lower portion 50 of grip 34. Finger rest 52, which preferably is threaded, is received in a hole in the hollow cylinder 36 slightly above the knife. One purpose of the finger rest 52 is to ensure that the user's little finger does not come in contact with knife 40. In addition, finger rest 52 helps enable the user to positively locate the position of knife 40. Preferably the angle 53 between the longitudinal axis 55 of grip 34 and the longitudinal axis 57 of knife 40 is between seventy degrees)(70°) and one hundred ten degrees)(110°) and more preferably is approximately eighty degrees)(80°).

As in the case of the fork and spoon devices shown in FIGS. 1-4, the eating utensil which includes the knife fits comfortably in the palm of the user's hand. The configuration shown in FIGS. 5-8 helps stabilize the whole hand and the weight of the eating device or knife, which is preferably approximately five ounces, has a comfortable heft in the palm of the hand which adds stability, as is the case of the fork and spoon.

While not shown in FIGS. 5-8, the knife eating utensil may also include a cap like cap 22 shown in FIGS. 1-4 which may be removed for washing.

Figure 5:
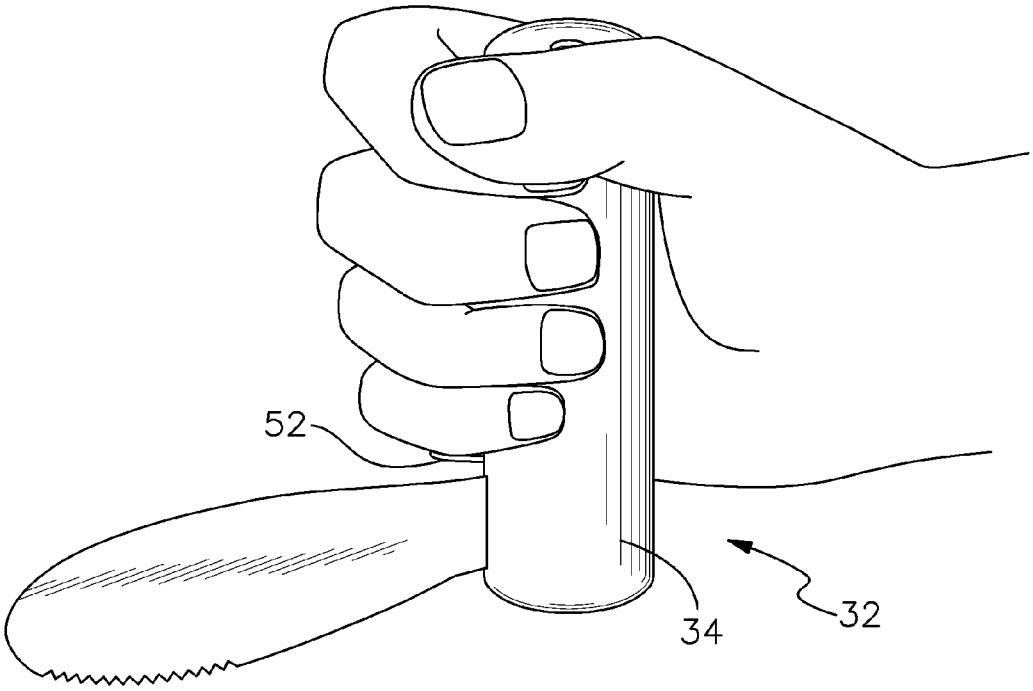
FIG. 5 is a perspective view showing another embodiment of the invention being grasped by a human hand.
Figure 7:
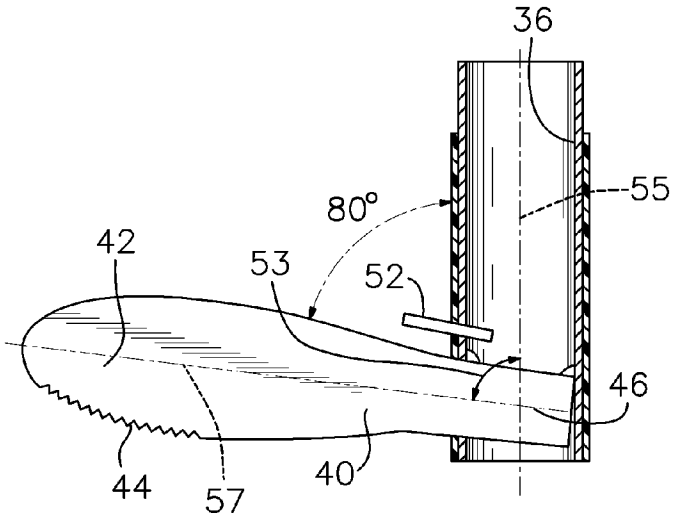
FIG. 7 is sectional view of the apparatus of FIG. 6 taken through section line 7-7 with the top removed and with the knife not shown in section.
Figure 8:
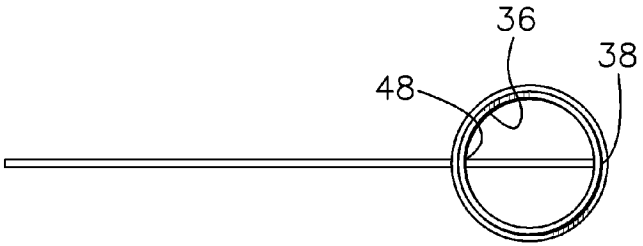
FIG. 8 is a top view of the embodiment of FIG. 7.
Figure 6:
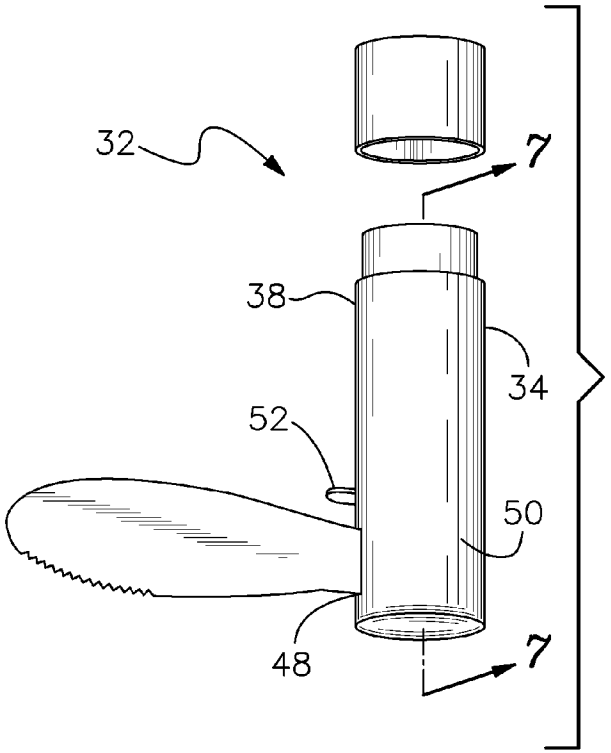
FIG. 6 is a side elevational view of the apparatus of FIG. 5.

When the user is holding eating device 32 as shown in FIG. 5 and moves to cut the food on the plate, he or she squeezes grip 34 in a firm fashion, which will result in the tremor virtually stopping. After the food is cut, the user puts the eating utensil down and thus relaxes the grip. The user can eat at his or her own pace and the eating process is much less tiring and stressful.

From the foregoing description of the embodiments of the invention, it will be apparent that many modifications may be made therein. It will be understood that these embodiments of the invention are an exemplification of the invention only and that the invention is not limited thereto.

What is claimed is:

1. An eating device comprising:

a grip; the grip being configured so as to enable the grip to be grasped by a human hand; the grips being an elongated tube;

an elongated utensil having a front portion and a rear portion; the front portion configured to make contact with food; the rear portion connected to the grip; the elongated utensil extending away from the grip; the elongated utensil having a longitudinal axis; the grip having a longitudinal axis; the angle between the longitudinal axis of the grip and the longitudinal axis of the elongated utensil being no less than seventy degrees)(70°) and no greater than one hundred ten degrees (110°);

a plastic sheath covering the tube; the plastic sheath including a lower cover and a cap; the lower cover and the cap being adjacent to one another; the cap being removable from the tube; the elongated utensil extending from the tube and the lower portion of the plastic sheath; and a finger rest;

wherein the elongate tube includes a first opening and a second opening; the first opening is provided adjacent to an end of the elongated tube;

wherein the rear portion of the elongated utensil extends into an interior of the elongated tube such that the rear portion of the elongated utensil is received in the first opening of the elongated tube, and an end of the rear portion of the elongated utensil opposite to the front portion is attached to an inner surface of the elongated tube at a location opposite to the first and second openings of the elongated tube;

wherein the finger rest is received in the second opening of the elongated tube.

2. An eating device as set forth in claim 1 wherein the grip is cylindrically shaped.

3. An eating device as set forth in claim 2 wherein the diameter of the cylindrical shaped grip being at least one inch (1").

4. An eating device as set forth in claim 1 wherein the front portion of the elongated utensil being at approximately the same elevation relative to the longitudinal axis of the grip as the rear portion of the elongated utensil.

5. An eating device as set forth in claim 1 wherein the elongated utensil is substantially straight.

6. An eating device as set forth in claim 1 wherein the utensil is a knife.

7. An eating device as set forth in claim 6 wherein the grip includes upper and lower portions, and a top and a bottom.

8. An eating device as set forth in claim 7 wherein the elongated utensil is attached to the lower portion of the grip above the bottom.

9. An eating device as set forth in claim 8, wherein the finger rest is attached to the lower portion above the knife.

10. A method for enabling a person afflicted with a neuromuscular disorder to manipulate food without substantial hand tremors comprising:

providing the eating device according to claim 1;

arranging the eating device so that the elongated grip extends substantially vertically and the elongated utensil extends substantially horizontally;

grasping the grip in the handshake position;

applying pressure to the grip by squeezing the grip wherein hand tremors are substantially relieved; and contacting food with the elongated utensil.

11. A method as set forth in claim 10, further including placing the fingers on the grip so that the elongated utensil is positioned below fingers.

12. A method as set forth in claim 10 further including placing the little finger on the finger rest.

* * * * *